US009856550B2

(12) United States Patent
Im et al.

(10) Patent No.: US 9,856,550 B2
(45) Date of Patent: Jan. 2, 2018

(54) HIGH CARBON HOT ROLLED STEEL SHEET HAVING EXCELLENT MATERIAL UNIFORMITY AND METHOD FOR MANUFACTURING THE SAME

(71) Applicant: POSCO, Pohang-si, Gyeongsangbuk-do (KR)

(72) Inventors: Young-Roc Im, Pohang-si (KR); Jea-Chun Jeon, Pohang-si (KR); Byoung-Ho Lee, Pohang-si (KR)

(73) Assignee: POSCO, Gyeongsangbuk-Do (KR)

( * ) Notice: Subject to any disclaimer, the term of this patent is extended or adjusted under 35 U.S.C. 154(b) by 573 days.

(21) Appl. No.: 14/391,454

(22) PCT Filed: Dec. 27, 2012

(86) PCT No.: PCT/KR2012/011643
§ 371 (c)(1),
(2) Date: Oct. 9, 2014

(87) PCT Pub. No.: WO2013/154254
PCT Pub. Date: Oct. 17, 2013

(65) Prior Publication Data

US 2015/0107725 A1 Apr. 23, 2015

(30) Foreign Application Priority Data

Apr. 10, 2012 (KR) ..... 10-2012-0037318

(51) Int. Cl.
*C21D 11/00* (2006.01)
*C22C 38/00* (2006.01)
(Continued)

(52) U.S. Cl.
CPC ..... *C22C 38/32* (2013.01); *C21D 8/02* (2013.01); *C21D 8/0205* (2013.01);
(Continued)

(58) Field of Classification Search
CPC ..... C22C 38/32; C22C 38/04; C22C 38/001; C22C 38/02; C22C 38/28; C22C 38/00;
(Continued)

(56) References Cited

U.S. PATENT DOCUMENTS 6,419,761 B1 7/2002 Hashimura et al.
2004/0202567 A1* 10/2004 Takada ..... B62D 3/12 420/121
(Continued)

FOREIGN PATENT DOCUMENTS

CN 102137946 7/2011
EP 1 905 850 4/2008
(Continued)

OTHER PUBLICATIONS

Machine translation of JP 2006-002172A (no date available).*
(Continued)

*Primary Examiner* — Kiley Stoner
(74) *Attorney, Agent, or Firm* — Cantor Colburn LLP

(57) ABSTRACT

The present invention relates to a high carbon hot rolled steel sheet having excellent material uniformity and a method for manufacturing the same, in which components and structure of the steel are precisely controlled and manufacturing conditions are adjusted to achieve excellence in material uniformity among hot rolled structures, thereby improving the dimensional precision of parts after formation, preventing defects during processing, and obtaining uniform structures and hardness distribution even after a final heat treatment process.

7 Claims, 1 Drawing Sheet

(51) Int. Cl.

| | |
|---|---|
| ***C22C 38/32*** | (2006.01) |
| ***C21D 8/02*** | (2006.01) |
| ***C21D 9/46*** | (2006.01) |
| ***C22C 38/06*** | (2006.01) |
| ***C22C 38/02*** | (2006.01) |
| ***C22C 38/04*** | (2006.01) |
| ***C22C 38/28*** | (2006.01) |

(52) U.S. Cl.
CPC ..... *C21D 8/0226* (2013.01); *C21D 8/0263* (2013.01); *C21D 9/46* (2013.01); *C22C 38/00* (2013.01); *C22C 38/001* (2013.01); *C22C 38/02* (2013.01); *C22C 38/04* (2013.01); *C22C 38/06* (2013.01); *C22C 38/28* (2013.01); *C21D 2211/009* (2013.01)

(58) Field of Classification Search
CPC .... C22C 38/06; C21D 8/0205; C21D 8/0226; C21D 8/0263; C21D 8/02; C21D 9/46; C21D 2211/009
USPC ..... 420/8–129
See application file for complete search history.

(56) References Cited

U.S. PATENT DOCUMENTS

| | | | | |
|---|---|---|---|---|
| 2006/0048864 | A1* | 3/2006 | Nagao | C21D 8/06 148/320 |
| 2008/0295923 | A1 | 12/2008 | Lee et al. | |
| 2009/0087337 | A1* | 4/2009 | Saitoh | C22C 38/02 420/106 |
| 2013/0153091 | A1* | 6/2013 | Fujita | C21D 8/0226 148/504 |
| 2013/0199676 | A1* | 8/2013 | Tomokiyo | C21D 9/46 148/518 |
| 2013/0233453 | A1* | 9/2013 | Kawamura | C21D 8/0226 148/602 |
| 2013/0244056 | A1* | 9/2013 | Kawamura | C21D 8/0226 428/659 |
| 2015/0284819 | A1* | 10/2015 | Tamaki | C22C 38/001 148/533 |
| 2015/0368768 | A1* | 12/2015 | Aratani | C22C 38/00 420/83 |
| 2016/0002755 | A1* | 1/2016 | Ishida | C22C 38/00 428/659 |
| 2016/0010196 | A1* | 1/2016 | Ishida | C22C 38/06 428/659 |
| 2016/0060722 | A1* | 3/2016 | Suwa | C22C 38/001 420/83 |
| 2016/0265078 | A1* | 9/2016 | Kajihara | B21B 3/00 |
| 2017/0051372 | A1* | 2/2017 | Tomokiyo | C21D 9/0068 |
| 2017/0145531 | A1* | 5/2017 | Hayashi | C21D 9/0068 |

FOREIGN PATENT DOCUMENTS

| | | |
|---|---|---|
| JP | 8-337843 | 12/1996 |
| JP | 2001-140037 | 5/2001 |
| JP | 2005-97740 | 4/2005 |
| JP | 2005-344194 | 12/2005 |
| JP | 2006-002172 | 1/2006 |
| JP | 2006-063394 | 3/2006 |
| JP | 2005-133200 | 5/2006 |
| JP | 2005-344196 | 12/2006 |
| JP | 2007-31762 | 2/2007 |
| JP | 2007-270326 | 10/2007 |
| JP | 2010-144242 | 7/2010 |
| KR | 10-2007-0068289 | 6/2007 |

OTHER PUBLICATIONS

Machine translation of JP 2007-270326A (no date available).*
International Search Report from the Korean Patent Office for International Application No. PCT/KR2012/011643 dated Apr. 25, 2013.
First Office Action from the State Intellectual Property Office of the People's Republic of China in counterpart Chinese Patent Application 201280072311.8, dated Nov. 4, 2015.
Extended European Search Report from the European Patent Office in counterpart European Patent Application No. EP 12873979.4, dated Dec. 17, 2015.

* cited by examiner

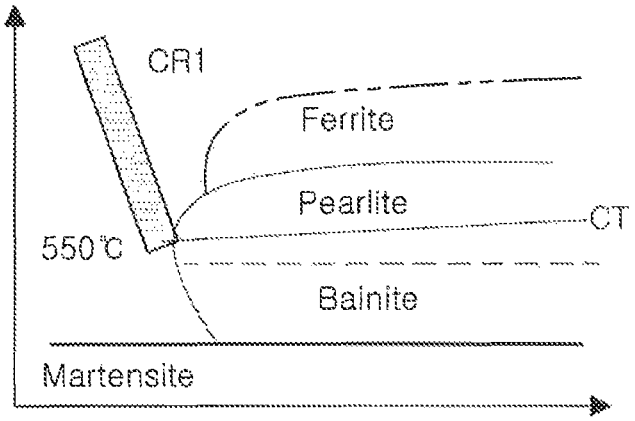
CR1
Ferrite
Pearlite
CT
550℃
Bainite
Martensite

HIGH CARBON HOT ROLLED STEEL SHEET HAVING EXCELLENT MATERIAL UNIFORMITY AND METHOD FOR MANUFACTURING THE SAME

CROSS REFERENCE TO RELATED PATENT APPLICATIONS

This application is a national phase of international Application No. PCT/KR2012/011643, filed on Dec. 27, 2012, which claims the priority of Korean Patent Application No. 10-2012-0037318, filed in the Korean Intellectual Property Office on Apr. 10, 2012, all of which applications are incorporated herein in their entireties by reference.

TECHNICAL FIELD

The present disclosure relates to a high carbon hot rolled steel sheet having excellent material uniformity, and more particularly, to a high carbon hot rolled steel sheet having excellent material uniformity that may be used in machine parts, tools, automobile parts, and the like, and a method for manufacturing the same.

BACKGROUND ART

High carbon hot rolled steel sheets using high carbon steel have been used in various applications, e.g., machine parts, tools, automobile parts, and the like. Such steel sheets, suitable for the above-described applications, are manufactured by forming hot rolled steel sheets having corresponding target thicknesses, performing blanking, bending and press-forming on the hot rolled steel sheets to obtain desired shapes, and finally performing a heat treatment process on the hot rolled steel sheets to impart high hardness to the hot rolled steel sheets.

High carbon hot rolled steel sheets may require excellent material uniformity because high material deviations in the high carbon hot rolled steel sheets not only worsen dimensional precision in a forming process and cause defects during processing, but also lead to non-uniform structure distribution even in a final heat treatment process.

Although various inventions have been suggested to improve the formability of high carbon hot rolled steel sheets, most inventions have only focused on controlling the sizes and distribution of carbides in microstructures after a cold rolling process and an annealing process, no invention regarding the formability and heat treatment uniformity of hot rolled steel sheets has been proposed.

More specifically, patent document 1, related to the formability of a high carbon annealed steel sheet obtained after performing cold rolling and annealing discloses that the formability of the steel sheet is improved if a carbide distribution, in which an average carbide particle diameter is 1 μm or less and a fraction of carbides having a particle diameter of 0.3 μm or less is 20% or less, is obtained by controlling annealing conditions. However, there is no mention of the formability of a hot rolled steel sheet. Moreover, carbides do not necessarily have to be formed to have a particle diameter of 1 μm or less after annealing a hot rolled steel sheet having excellent formability.

Further, even in patent document 2 in which a ferrite particle diameter of 5 μm or more and a carbide particle diameter standard deviation of 0.5 or less are prescribed by properly controlling annealing conditions, there is no mention of hot rolled structure, and a hot rolled steel sheet having excellent formability does not necessarily have to maintain the same carbide distribution as in the above-mentioned invention after being treated under ordinary annealing conditions.

Patent document 3 discloses that fine blanking workability increases when ferrite grain sizes satisfy a range of 10 μm to 20 μm while maintaining fractions of pearlite and cementite to levels of 10% or less. Although the disclosed invention specifies the controlling of the microstructure of an annealed steel sheet, the formability of the disclosed invention is far from that of a hot rolled structure. On the contrary, as a method of improving the formability of a hot rolled structure, if the formation of ferrite is suppressed and a uniform phase distribution is obtained, material deviations may be minimized.

Patent document 4 suggests a hot rolled structure-prescribing method of obtaining a ferrite fraction of about 10% or less by adjusting a ferrite particle diameter to be 6 μm or less after annealing and a carbide particle diameter to be within the range of 0.1 μm to 1.2 μm after annealing, and cooling a hot rolled steel sheet at a rate of 120° C. per second or higher. However, the disclosed invention is for improving stretch-flangeability of an annealed steel sheet, and a fast cooling rate of 120° C./sec is not always required to form a hot rolled steel sheet having a ferrite fraction of about 10% or less.

Patent document 5 suggests a method of improving the formability of an annealed steel sheet by adjusting fractions of pro-eutectoid ferrite and pearlite to be 5% or less respectively, forming a high carbon bainite structure having a bainite fraction of 90% or more, and forming a structure in which fine cementite is distributed after annealing. However, the disclosed invention is only for improving the formability of an annealed steel sheet by finely adjusting an average carbide size to be 1 μm or less and a grain size to be 5 μm or less, but is not related to the formability of a hot rolled steel sheet.

(Patent document 1) Japanese Patent Application Laid-open Publication No. 2005-344194

(Patent document 2) Japanese Patent Application Laid-open Publication No. 2005-344196

(Patent document 3) Japanese Patent Application Laid-open Publication No. 2001-140037

(Patent document 4) Japanese Patent Application Laid-open Publication No. 2006-063394

(Patent document 5) Korean Patent Application Laid-open Publication No. 2007-0068289

DISCLOSURE

Technical Problem

In order to solve the above-described problems, an aspect of the present disclosure may provide a high carbon hot rolled steel sheet capable of securing excellent material uniformity by controlling kinds and contents of alloying elements and structures thereof, and a method for manufacturing the high carbon hot rolled steel sheet.

Technical Solution

According to an aspect of the present disclosure, a high carbon hot rolled steel sheet having excellent material uniformity may include 0.2% by weight to 0.5% by weight of carbon (C), more than 0% by weight to 0.5% by weight of silicon (Si), 0.2% by weight to 1.5% by weight of manganese (Mn), more than 0% by weight to 1.0% by weight of chromium (Cr), more than 0% by weight to 0.03% by weight of phosphorous (P), more than 0% by weight to 0.015% by weight of sulfur (S), more than 0% by weight to 0.05% by weight of aluminum (Al), 0.0005% by weight to 0.005% by weight of boron (B), 0.005% by weight to 0.05% by weight of titanium (Ti), more than 0% by weight to 0.01% by weight of nitrogen (N), and the balance of iron (Fe) and unavoidable impurities, wherein the high carbon hot rolled steel sheet may include a pearlite phase having an area fraction of 95% or more.

According to another aspect of the present disclosure, a method for manufacturing a high carbon hot rolled steel sheet having excellent material uniformity may include: manufacturing a high carbon steel slab including 0.2% by weight to 0.5% by weight of C, more than 0% by weight to 0.5% by weight of Si, 0.2% by weight to 1.5% by weight of Mn, more than 0% by weight to 1.0% by weight of Cr, more than 0% by weight to 0.03% by weight of P, more than 0% by weight to 0.015% by weight of S, more than 0% by weight to 0.05% by weight of Al, 0.0005% by weight to 0.005% by weight of B, 0.005% by weight to 0.05% by weight of Ti, more than 0% by weight to 0.01% by weight of N, and the balance of Fe and unavoidable impurities; reheating the slab at a temperature of 1,100° C. to 1,300° C.; hot rolling the reheated slab such that a finishing hot rolling temperature is in a temperature range of 800° C. to 1,000° C.; cooling the hot rolled steel sheet at a cooling rate CR1 satisfying the following formula 1 or 1' until a temperature of the hot rolled steel sheet reaches 550° C. from the finishing hot rolling temperature; and coiling the cooled steel sheet at a coiling temperature CT satisfying the following formula 2, $$\text{Cond1} \le \text{CR1}(^\circ\text{C./sec}) < 100,$$

$$\text{Cond1} = \text{a larger value between } 175-300\times C(\text{wt. \%})-30\times Mn(\text{wt. \%})-100\times Cr(\text{wt. \%}) \text{ and } 10 \quad \text{[Formula 1]}$$

$$\text{Cond1} \le \text{CR1}(^\circ\text{C./sec}) \le \text{Cond1}+20,$$

$$\text{Cond1} = \text{a larger value between } 175-300\times C(\text{wt. \%})-30\times Mn(\text{wt. \%})-100\times Cr(\text{wt. \%}) \text{ and } 10 \quad \text{[Formula 1']}$$

$$\text{Cond2} \le \text{CT}(^\circ\text{C.}) \le 650,$$

$$\text{Cond2} = 640-237\times C(\text{wt. \%})-16.5\times Mn(\text{wt. \%})-8.5\times Cr(\text{wt. \%}). \quad \text{[Formula 2]}$$

Advantageous Effects

According to embodiments of the present disclosure, a high carbon hot rolled steel sheet having excellent material uniformity and a method for manufacturing the same are provided, wherein elements, microstructure, and process conditions of the steel sheet are controlled to achieve excellence in material uniformity among hot rolled structures of the high carbon hot rolled steel sheet, thereby guaranteeing excellent dimensional precision of parts after formation, preventing defects during processing, and guaranteeing uniform structure and hardness distribution even after a final heat treatment process.

DESCRIPTION OF DRAWINGS

FIG. 1 is a graph illustrating transformation curves of a hot rolled steel sheet with respect to a cooling rate.

BEST MODE

The present inventors have conducted significant research into devising a steel material having excellent material uniformity that is a property required in a high carbon hot rolled steel sheet. Using the results of the research, the present inventors completed the present disclosure after confirming that a steel material having excellent material uniformity can be provided by precisely controlling alloy element contents and process conditions, particularly cooling conditions and coiling conditions as functions of alloy elements, to obtain a pearlite structure of 95% or more.

Hereinafter, a high carbon hot rolled steel sheet having excellent material uniformity as an aspect of the present disclosure will be described.

A high carbon hot rolled steel sheet according to an embodiment of the present disclosure may include 0.2% by weight to 0.5% by weight of C, more than 0% by weight to 0.5% by weight of Si, 0.2% by weight to 1.5% by weight of Mn, more than 0% by weight to 1.0% by weight of Cr, more than 0% by weight to 0.03% by weight of P, more than 0% by weight to 0.015% by weight of S, more than 0% by weight to 0.05% by weight of Al, 0.0005% by weight to 0.005% by weight of B, 0.005% by weight to 0.05% by weight of Ti, more than 0% by weight to 0.01% by weight of N, and the balance of Fe and unavoidable impurities.

The high carbon hot rolled steel sheet may preferably include 0.2% by weight to 0.4% by weight of C.

Further, the high carbon hot rolled steel sheet may preferably include 0.4% by weight to 0.5% by weight of C.

Hereinafter, in the embodiment of the present disclosure, reasons for specifying elements of the high carbon hot rolled steel sheet as described above will be described in detail. In the following description, the contents of constitutional elements are given in percent by weight (wt. %).

C: 0.2% by Weight to 0.5% by Weight

Carbon (C) is an element required for securing hardenability during heat treatment and hardness after heat treatment, and C is preferably contained in an amount of 0.2% by weight or more to secure hardenability during heat treatment and hardness after heat treatment. However, if C is contained in an amount of more than 0.5% by weight, it may be difficult to obtain excellent material uniformity as intended in the present disclosure because a very high hot rolling hardness is maintained to result in an increase in the absolute values of material deviations and deterioration of formability.

If C is contained in an amount range of 0.2% by weight to 0.4% by weight, since the steel sheet is soft before a final heat treatment process, forming processes such as pulling-out, forging, and drawing are easily performed for manufacturing complicated machine parts.

Further, if C is contained in an amount range of 0.4% by weight to 0.5% by weight, although processing is relatively difficult in forming processes, abrasion resistance and fatigue resistance of the high carbon hot rolled steel sheet are excellent due to a high degree of hardness of the steel sheet after final heat treatment, and thus the steel sheet may be usefully used for manufacturing groups of machine parts operating in high load conditions.

Si: More than 0% by Weight to 0.5% by Weight

Silicon (Si) is an element added along with Al for the purpose of deoxidation. If Si is added, the adverse effect of producing red scale may be suppressed, while ferrite may be stabilized to result in increases of material deviations. Therefore, the upper limit of the content of C may preferably be set to 0.5% by weight.

Mn: 0.2% by Weight to 1.5% by Weight

Manganese (Mn) is an element contributing to increasing hardenability and securing hardness after heat treatment. If the content of Mn is very low to be within the range of less than 0.2% by weight, the steel sheet may become very vulnerable because a coarse FeS is formed. On the other hand, if the content of Mn is greater than 1.5% by weight, alloying costs may be increased, and residual austenite may be formed.

Cr: More than 0% by Weight to 1.0% by Weight

Chromium (Cr) is an element contributing to increasing hardenability and securing hardness after heat treatment. Further, Cr contributes to improving formability of the steel sheet by finely adjusting a pearlite lamellar spacing. When Cr is contained in an amount of more than 1.0% by weight, alloying costs are increased, and phase transformation is excessively delayed such that it may be difficult to obtain a sufficient phase transformation when cooling the steel sheet in a run out table (ROT). Therefore, the upper limit of the content of Cr may preferably be set to be 1.0% by weight.

P: More than 0% by Weight to 0.03% by Weight

Phosphorous (P) is an impurity element in the steel sheet. It may be preferable to set the upper limit of the content of P to be 0.03% by weight. If P is contained in an amount of more than 0.03% by weight, the weldability of the steel sheet may be deteriorated, and the steel sheet may become brittle.

S: More than 0% by Weight to 0.015% by Weight

Like phosphorous, sulfur (S) is an impurity element worsening the ductility and weldability of the steel sheet. Therefore, it may be preferable to set the upper limit of content of S to be 0.015% by weight. If S is contained in an amount of more than 0.015% by weight, the possibility of lowering the ductility and weldability of the steel sheet is increased.

Al: More than 0% by Weight to 0.05% by Weight

Aluminum (Al) is an element for deoxidation and functions as a deoxidizer during a steelmaking process. The necessity of containing Al in an amount of more than 0.05% by weight is low, and nozzles may be clogged during a continuous casting process if Al is contained in an excessive amount. Therefore, it may be preferable to set the upper limit of the content of Al to be 0.05% by weight.

B: 0.0005% by Weight to 0.005% by Weight

Boron (B) is an element greatly contributing to securing hardenability of the steel sheet and thus may be added in an amount of 0.0005% by weight or more to obtain a hardenability-reinforcing effect. However, if B is added in an excessive amount, boron carbide may be formed on grain boundaries to form nucleus forming sites and rather worsen hardenability. Therefore, it may be preferable to set the upper limit of the content of B to be 0.005% by weight.

Ti: 0.005% by Weight to 0.05% by Weight

Since titanium (Ti) forms TiN by reacting with nitrogen (N), titanium (Ti) is added as an element for suppressing the formation of BN, so-called boron protection. If the content of Ti is less than 0.005% by weight, nitrogen contained in the steel sheet may not be effectively fixated. On the other hand, if the content of Ti is excessive, the steel sheet may become vulnerable due to the formation of coarse TiN. Therefore, the content of Ti may be adjusted to be within a range in which nitrogen contained in the steel sheet is sufficiently fixed. Therefore, it may be preferable to set the upper limit of Ti to be 0.05% by weight.

N: More than 0% by Weight to 0.01% by Weight

Nitrogen (N) is an element that contributes to the hardness of a steel material, but N is an element that is difficult to be controlled. If N is contained in an amount of more than 0.01% by weight, brittleness may be greatly increased, and B contributing to hardenability may be consumed in the form of BN by surplus N remaining after the formation of TiN. Therefore, it may be preferable to set the upper limit of N to be 0.01% by weight.

The high carbon hot rolled steel sheet of the embodiment of the present disclosure includes Fe and unavoidable impurities in addition to the above-described constituent elements.

It is required to additionally limit the type and shape of the internal structure of the steel sheet having the above-described components so that the steel sheet may become a high carbon hot rolled steel sheet having excellent material uniformity.

Namely, according to an embodiment of the present disclosure, it may be preferable that the microstructure of the high carbon hot rolled steel sheet may have pearlite in an area fraction of 95% or more.

If the fraction of pearlite phase is less than 95%, i.e., if a pro-eutectoid ferrite phase, a bainite phase or a martensite phase is formed to a fraction of 5% or more, the material deviation of the steel sheet may be increase, and thus it may be difficult to impart material uniformity to the steel sheet.

Further, it may be preferable that the area fraction of pearlite phase be 75% or more before coiling. The pearlite phase imparts material uniformity to the hot rolled steel sheet. If the area fraction of pearlite is 75% or more before coiling, pearlite colonies surrounded by tilt grain boundaries having a misorientation angle of 15° or more may be formed to an average size of 15 μm or less, and thus a fine and uniform structure may be obtained. Accordingly, the fine and uniform structure enables the hot rolled steel sheet to have a more uniform material deviation.

If the pearlite phase formed before coiling has an insufficient fraction of less than 75%, a large amount of latent heat of transformation is accumulated in a coil after coiling such that partial spheroidizing of a pearlite structure proceeds to cause a high hardness deviation and coarsen a lamella structure due to heat of transformation. Therefore, a low hardness structure is partially formed. Further, a ferrite phase or a bainite phase may be formed during transformation.

As described above, according to the present disclosure, most pearlite transformation occurs in a relatively low temperature range before coiling such that a small average interlamellar spacing of 0.1 μm or less may be obtained in the final microstructure of the steel sheet, and thus the material uniformity of the steel sheet may further be improved.

In order to manufacture a high carbon hot rolled steel sheet satisfying the purpose of the embodiment of the present disclosure as described above, an example devised by the present inventors will be described hereinafter in detail. However, the embodiments of the present disclosure are not limited to the example.

A method for manufacturing a high carbon hot rolled steel sheet according to an embodiment of the present disclosure may generally include heating a steel slab satisfying the above-described element system and microstructure, rolling the heated slab, performing finishing rolling on the rolled slab in a temperature range of 800° C. to 1,000° C., and cooling and coiling the finish rolled steel sheet.

Hereinafter, detailed conditions for the respective processes will be described.

Reheating: 1,100° C. to 1,300° C.

Since the heating of the slab is a heating process for smoothly performing a succeeding rolling process and sufficiently obtaining target physical properties of a steel sheet, the heating process is carried out within a proper temperature range to obtain target physical properties.

When reheating the slab, there is a problem that a hot rolling load is rapidly increased if the heating temperature is less than 1,100° C. On the other hand, if the heating temperature is higher than 1,300° C., an increased amount of scale may be on the surface of the slab to increase the amount of material loss and heating costs.

Rolling Conditions

When the reheated slab is hot-rolled to form a steel sheet, the temperature of finish hot rolling is set to be within the range of 800° C. to 1,000° C.

During the hot rolling, a rolling load may be greatly increased if the finish hot rolling temperature is lower than 800° C. On the other hand, if the finish hot rolling temperature is higher than 1,000° C., the structure of the steel sheet may be coarsened and rendered brittle, and a thick layer of scale may be formed on the steel sheet to worsen the surface quality of the steel sheet.

Cooling Conditions

When cooling the hot rolled steel sheet, the hot rolled steel sheet is cooled in a water-cooling ROT until the temperature of the steel sheet reaches 550° C. from the finish hot rolling temperature.

At this time, the steel sheet is cooled at a cooling rate CR1 lower than 100° C./sec but equal to or higher than Cond1 as represented by Formula 1 below. If the cooling rate CR1 is lower than the Cond1 calculated by Formula 1 below, a ferrite phase is formed during cooling, resulting in a hardness difference of 30 Hv or greater. On the other hand, if the cooling rate CR1 exceeds 100° C./sec, the shape of the steel sheet deteriorates markedly.

In the embodiment of the present disclosure, Boron (B) is added, and the contents of C, Mn and Cr are controlled. Therefore, a target degree of material uniformity may be obtained even at a usual cooling rate.

$$\text{Cond1} \leq \text{CR1}(^\circ\ \text{C./sec}) < 100,$$

$$\text{Cond1} = \text{a larger value between } 175-300\times C(\text{wt. \%})-30\times Mn(\text{wt. \%})-100\times Cr(\text{wt. \%}) \text{ and } 10 \qquad \text{[Formula 1]}$$

Further, the cooling rate CR1 may be adjusted to be within a range of not less than Cond1 to not more than Cond1+20° C./sec as represented by Formula 1' below. If the cooling rate CR1 is controlled as represented by Formula 1', the formation of a ferrite phase is prevented, and along with this the temperature of the steel sheet is not far deviated from a nose temperature of phase transformation to facilitate pearlite transformation in the subsequent process.

$$\text{Cond1} \leq \text{CR1}(^\circ\ \text{C./sec}) \leq \text{Cond1}+20,$$

$$\text{Cond1} = \text{a larger value between } 175-300\times C(\text{wt. \%})-30\times Mn(\text{wt. \%})-100\times Cr(\text{wt. \%}) \text{ and } 10 \qquad \text{[Formula 1']}$$

Coiling Conditions

After the steel sheet passes through the water-cooling ROT, the steel sheet is coiled into a roll. At this time, the temperature of the steel sheet is adjusted to a coiling temperature CT satisfying Formula 2 by means of recuperative heat or additional cooling.

If the coiling temperature exceeds 650° C., a ferrite phase may be formed in a retention stage after the coiling process although manufacturing conditions such as the above-described cooling conditions are satisfied. On the other hand, if the coiling temperature is less than Cond2 calculated by Formula 2, a bainite phase may be formed to increase the hardness difference of the steel sheet $$\text{Cond2} \leq \text{CT}(^\circ\ \text{C.}) \leq 650,$$

$$\text{Cond2} = 640-237\times C(\text{wt. \%})-16.5\times Mn(\text{wt. \%})-8.5\times Cr(\text{wt. \%}) \qquad \text{[Formula (2)]}$$

When manufacturing a high carbon hot rolled steel sheet, constituent elements are controlled, and at the same time, the rate of cooling and the temperature of coiling are controlled as shown in FIG. 1. Then, a pearlite phase may be formed to an area fraction of 75% or more prior to a coiling process. If a pearlite phase is formed to an area fraction of 75% or more before a coiling process, the area fraction of the pearlite phase in the steel sheet may become 95% or more after the coiling process.

Further, manufacturing conditions such as constituent elements and cooling rates are controlled so as to form pearlite colonies having an average size of 15 μm or less and adjust an average interlamellar spacing to be 0.1 μm or less, thereby reducing a hardness difference between microstructures of the hot rolled steel sheet to 30 HV or less and imparting excellent material uniformity to the hot rolled steel sheet. At this time, the hardness difference is defined as a difference between a 95% hardness level and a 5% hardness level when a maximum hardness value and a minimum hardness value measured in the hot rolled steel sheet are set as 100% and 0% respectively.

The hot rolled steel sheet manufactured by the method of the embodiment of the present disclosure may be used without performing additional processes thereon, or may be used after performing processes such as an annealing process thereon.

Hereinafter, the embodiments of the present disclosure will be described in more detail through examples. However, the embodiments of the present disclosure are not limited thereto.

MODE FOR INVENTION

Examples

After steels having alloy compositions as represented by Table 1 below were vacuum melted into 30 Kg ingots, a sizing rolling process was performed on the vacuum melted ingots to manufacture slabs having a thickness of 30 mm. After the slabs were reheated at 1,200° C. for one hour, a hot rolling process was carried out on the reheated slabs, wherein a finish hot rolling process was conducted on the reheated slabs at 900° C. to manufacture hot rolled steel sheets having a final thickness of 3 mm.

After the finish hot rolling process, the steel sheets were cooled to 550° C. at cooling rates CR1 in a water-cooling ROT. The cooled steel sheets were charged into a furnace that had already been heated to a target coiling temperature, and retained in the furnace for one hour. Then, after furnace cooling, an experimental hot-rolling coiling process was performed on the steel sheets. At that time, cooling rates CR1 and coiling temperatures CT shown in Table 2 below were used for the steel sheets.

Further, microstructures of final hot rolled steel sheets obtained by completing the coiling process were analyzed, and Vickers hardness values of the final hot rolled steel sheets were measured as shown in Table 2 below. At that time, the hardness values were measured in Vickers hardness using a 500 g weight, and a hardness difference was defined as a difference between a 95% hardness level and a 5% hardness level when the maximum hardness value and the minimum hardness value among hardness values measured by repeating the measurement 30 or more times were set as 100% and 0% respectively.

TABLE 1

| Steel type | C | Si | Mn | Cr | B | Ti | Al | P | S | N | Remarks for reference |
|---|---|---|---|---|---|---|---|---|---|---|---|
| A | 0.201 | 0.192 | 0.706 | 0.211 | 0.0021 | 0.020 | 0.033 | 0.011 | 0.0032 | 0.0040 | Inventive steel |
| B | 0.215 | 0.102 | 0.981 | 0.003 | 0.0019 | 0.0019 | 0.033 | 0.012 | 0.0022 | 0.0042 | Inventive steel |
| C | 0.225 | 0.117 | 0.722 | 0.430 | 0.0002 | 0.002 | 0.021 | 0.014 | 0.0057 | 0.0059 | Comparative steel |
| D | 0.233 | 0.201 | 1.113 | 0.006 | 0.0022 | 0.019 | 0.018 | 0.013 | 0.0042 | 0.0043 | Inventive steel |
| E | 0.248 | 0.122 | 0.927 | 0.495 | 0.0020 | 0.023 | 0.015 | 0.015 | 0.0037 | 0.0052 | Inventive steel |
| F | 0.312 | 0.21 | 0.812 | 0.002 | 0.0019 | 0.021 | 0.017 | 0.017 | 0.0021 | 0.0037 | Inventive steel |
| G | 0.347 | 0.152 | 0.325 | 0.750 | 0.0011 | 0.019 | 0.021 | 0.018 | 0.0015 | 0.0040 | Inventive steel |
| H | 0.362 | 0.215 | 1.370 | 0.003 | 0.0020 | 0.021 | 0.019 | 0.012 | 0.0012 | 0.0049 | Inventive steel |
| I | 0.371 | 0.075 | 0.867 | 0.512 | 0.0014 | 0.019 | 0.042 | 0.009 | 0.0032 | 0.0032 | Inventive steel |
| J | 0.384 | 0.045 | 0.912 | 0.007 | 0.0022 | 0.021 | 0.038 | 0.008 | 0.0027 | 0.007 | Inventive steel |
| K | 0.409 | 0.063 | 0.399 | 0.212 | 0.0022 | 0.020 | 0.044 | 0.012 | 0.0084 | 0.0066 | Inventive steel |
| L | 0.397 | 0.211 | 0.415 | 0.003 | 0.0001 | 0.003 | 0.019 | 0.013 | 0.0067 | 0.0050 | Comparative steel |
| M | 0.466 | 0.327 | 0.315 | 0.125 | 0.0020 | 0.021 | 0.007 | 0.014 | 0.0039 | 0.0047 | Inventive steel |

TABLE 2

| Hot rolled steel sheet | Cond1 | CR1 | Cond2 | CT | Pearlite fraction | Colony size (μm) | Interlamellar spacing (μm) | Hardness deviation | Classification |
|---|---|---|---|---|---|---|---|---|---|
| A | 72 | 75 | 579 | 600 | 96% | 12 | 0.054 | 25 | Inventive Example |
| B | 81 | 85 | 573 | 600 | 98% | 13 | 0.058 | 19 | Inventive Example |
| C | 43 | 50 | 571 | 600 | 83% | 13 | 0.051 | 63 | Comparative Example |
| D | 71 | 75 | 566 | 600 | 99% | 12 | 0.059 | 21 | Inventive Example |
| E | 23 | 30 | 562 | 620 | 97% | 14 | 0.055 | 25 | Inventive Example |
| F | 57 | 75 | 553 | 580 | 99% | 12 | 0.053 | 16 | Inventive Example |
| G | 10 | 20 | 546 | 580 | 95% | 10 | 0.043 | 24 | Inventive Example |
| H | 25 | 30 | 532 | 580 | 97% | 9 | 0.059 | 18 | Inventive Example |
| I | 10 | 20 | 533 | 670 | 91% | 16 | 0.071 | 79 | Comparative Example |
| J | 32 | 50 | 534 | 580 | 99% | 10 | 0.054 | 17 | Inventive Example |
| K | 19 | 30 | 535 | 580 | 96% | 9 | 0.049 | 23 | Inventive Example |
| L | 43 | 50 | 539 | 620 | 87% | 13 | 0.055 | 82 | Comparative Example |
| M | 13 | 20 | 523 | 620 | 99% | 12 | 0.054 | 27 | Inventive Example |

(In Table 2, the remainders except for pearlite fractions are consisted of pro-eutectoid ferrite)

As results of measurement, in the case of Comparative Examples C and L using Comparative Steels C and L of Table 1 in which contents of boron (B) do not satisfy ranges provided by the embodiments of the present disclosure, although manufacturing conditions such as cooling conditions and coiling conditions satisfy the embodiments of the present disclosure, pearlite fractions were 83% and 87% respectively, i.e., the pearlite fractions do not satisfy ranges suggested by the embodiments of the present disclosure, and hardness deviations of 30 Hv or more were also measured.

Further, in the case of Comparative Example I of Table 2 in which coiling temperature conditions do not satisfy the embodiments of the present disclosure, it can be seen that, as ferrite phase are formed at high coiling temperatures, pearlite fractions are 95% or less, and hardness deviations are 79 Hv, i.e., material uniformity of the steel sheets are inferior.

On the other hand, particularly in the case of Inventive Example F among Inventive Examples satisfying both composition ranges and manufacturing conditions provided by the embodiments of the present disclosure, a pearlite fraction was 99%, and a hardness deviation of 16 Hv was also measured.

Further, as results of measuring interlamellar spacings of inventive Examples, the measured interlamellar spacings were all 0.1 μm or less. Therefore, it was confirmed that very fine structures were formed.

It can be seen through the above-described results that a high strength hot rolled steel sheet having excellent material uniformity may be obtained when both composition ranges and manufacturing conditions provided by the embodiments of the present disclosure are satisfied.

The invention claimed is:

1. A high carbon hot rolled steel sheet comprising:

0. 2% by weight to 0.5% by weight of carbon (C), more than 0% by weight to 0.5% by weight of silicon (Si), 0.2% by weight to 1.5% by weight of manganese (Mn), more than 0% by weight to 1.0% by weight of chromium (Cr), more than 0% by weight to 0.03% by weight of phosphorous (P), more than 0% by weight to 0.015% by weight of sulfur (S), more than 0% by weight to 0.05% by weight of aluminum (Al), 0.0005% by weight to 0.005% by weight of boron (B), 0.005% by weight to 0.05% by weight of titanium (Ti), more than 0% by weight to 0.01% by weight of nitrogen (N), and the balance of iron (Fe) and unavoidable impurities, wherein the high carbon hot rolled steel sheet comprises a pearlite phase having an area fraction of 95% or more, and wherein the hot rolled steel sheet has a hardness difference of 30 HV or less between a 95% hardness level and a 5% hardness level when a maximum hardness value and a minimum hardness value of the hot rolled steel sheet are set as 100% and 0% respectively.

2. The high carbon hot rolled steel sheet of claim 1, wherein the pearlite phase has a colony size of 15 μm or less and an average interlamellar spacing of 0.1 μm or less.

3. The high carbon hot rolled steel sheet of claim 1, wherein 75% or more of the pearlite phase is formed prior to a coiling process.

4. The high carbon hot rolled steel sheet of claim 1, comprising 0.2% by weight to 0.4% by weight of C.

5. The high carbon hot rolled steel sheet of claim 1, comprising 0.4% by weight to 0.5% by weight of C.

6. A method for manufacturing a high carbon hot rolled steel sheet comprising:

manufacturing a high carbon steel slab comprising 0.2% by weight to 0.5% by weight of C, more than 0% by weight to 0.5% by weight of Si, 0.2% by weight to 1.5% by weight of Mn, more than 0% by weight to 1.0% by weight of Cr, more than 0% by weight to 0.03% by weight of P, more than 0% by weight to 0.015% by weight of S, more than 0% by weight to 0.05% by weight of Al, 0.0005% by weight to 0.005% by weight of B, 0.005% by weight to 0.05% by weight of Ti, more than 0% by weight to 0.01% by weight of N, and the balance of Fe and unavoidable impurities;

reheating the slab at a temperature of 1,100° C. to 1,300° C.;

hot rolling the reheated slab such that a finishing hot rolling temperature is in a temperature range of 800° C. to 1,000° C.;

cooling the hot rolled steel sheet at a cooling rate CR1 satisfying the following formula 1 until a temperature of the hot rolled steel sheet reaches 550° C. from the finishing hot rolling temperature, $$Cond1 \leq CR1(^\circ C./sec) < 100,$$

$$Cond1 = \text{a larger value between } 175-300\times C(wt.\%)-30\times Mn(wt.\%)-100\times Cr(wt.\%) \text{ and } 10; \text{ and} \quad \text{[formula 1]}$$

coiling the cooled steel sheet at a coiling temperature CT satisfying the following formula 2, $$Cond2 \leq CT(^\circ C.) \leq 650,$$

$$Cond2 = 640-237\times C(wt.\%)-16.5\times Mn(wt.\%)-8.5\times Cr(wt.\%), \quad \text{[Formula 2]}$$

wherein the hot rolled steel sheet comprises a pearlite phase having an area fraction of 95% or more after cooling.

7. A method for manufacturing a high carbon hot rolled steel sheet comprising:

manufacturing a high carbon steel slab comprising 0.2% by weight to 0.5% by weight of C, more than 0% by weight to 0.5% by weight of Si, 0.2% by weight to 1.5% by weight of Mn, more than 0% by weight to 1.0% by weight of Cr, more than 0% by weight to 0.03% by weight of P, more than 0% by weight to 0.015% by weight of S, more than 0% by weight to 0.05% by weight of Al, 0.0005% by weight to 0.005% by weight of B, 0.005% by weight to 0.05% by weight of Ti, more than 0% by weight to 0.01% by weight of N, and the balance of Fe and unavoidable impurities;

reheating the slab at a temperature of 1,100° C. to 1,300° C.;

hot rolling the reheated slab such that a finishing hot rolling temperature is in a temperature range of 800° C. to 1,000° C.;

cooling the hot rolled steel sheet at a cooling rate CR1 satisfying the following formula 1' until a temperature of the hot rolled steel sheet reaches 550° C. from the finishing hot rolling temperature, $$Cond1 \leq CR1(^\circ C./sec) \leq Cond1+20,$$

$$Cond1 = \text{a larger value between } 175-300\times C(wt.\%)-30\times Mn(wt.\%)-100\times Cr(wt.\%) \text{ and } 10; \text{ and} \quad \text{[Formula 1']}$$

coiling the cooled steel sheet at a coiling temperature CT satisfying the following formula 2:

$$Cond2 \leq CT(^\circ C.) \leq 650,$$

$$Cond2 = 640-237\times C(wt.\%)-16.5\times Mn(wt.\%)-8.5\times Cr(wt.\%), \quad \text{[Formula 2]}$$

wherein the hot rolled steel sheet comprises a pearlite phase having an area fraction of 95% or more after cooling.

* * * * *